US010745095B2

(12) United States Patent
He et al.

(10) Patent No.: US 10,745,095 B2
(45) Date of Patent: Aug. 18, 2020

(54) ELECTRIC OUTBOARD MOTOR FOR BOAT

(71) Applicant: CHANGZHOU GOLDEN MOTOR TECHNOLOGY CO., LTD, Changzhou (CN)

(72) Inventors: Zhang He, Changzhou (CN); Limin Zhang, Changzhou (CN); Bo Rao, Changzhou (CN)

( * ) Notice: Subject to any disclaimer, the term of this patent is extended or adjusted under 35 U.S.C. 154(b) by 264 days.

(21) Appl. No.: 16/101,381

(22) Filed: Aug. 10, 2018

(65) Prior Publication Data

US 2018/0362131 A1 Dec. 20, 2018

Related U.S. Application Data

(63) Continuation of application No. PCT/CN2016/107958, filed on Nov. 30, 2016.

(30) Foreign Application Priority Data

Oct. 25, 2016 (CN) ..... 2016 1 0939615

(51) Int. Cl.
*B63H 20/14* (2006.01)
*B63H 20/06* (2006.01)
(Continued)

(52) U.S. Cl.
CPC ..... *B63H 20/14* (2013.01); *B63H 20/007* (2013.01); *B63H 20/06* (2013.01); *B63H 20/08* (2013.01);
(Continued)

(58) Field of Classification Search
CPC ..... B63H 20/007; B63H 20/06; B63H 20/08; B63H 20/12; B63H 20/14; B63H 21/17;
(Continued)

(56) References Cited

U.S. PATENT DOCUMENTS 2,776,579 A * 1/1957 Nichel, Jr. ..... G05G 5/24 74/488
3,782,219 A * 1/1974 Beck ..... B63H 21/265 74/531
(Continued)

FOREIGN PATENT DOCUMENTS

CN 201082760 Y 7/2008
CN 201264717 Y 7/2009
(Continued)

OTHER PUBLICATIONS

Internation Search Report of PCT/CN2016/107958, dated Jul. 6, 2017.

*Primary Examiner* — Ajay Vasudeva
(74) *Attorney, Agent, or Firm* — Erson IP (Nelson IP)

(57) ABSTRACT

An electric inboard motor for a boat, includes a main body, a motor, a motor controller, a motor mounting base, a paddle, a paddle shall, a speed-adjusting handle assembly and a main body overturning locking mechanism. The speed-adjusting handle assembly further includes a speed-adjusting handle spindle, an axle sleeve, a handle sleeve, a button, a spring and at stop block; one end of a handle shell is fixedly connected with the stop block, and the handle sleeve abuts against a stepped face of the stop block, the speed-adjusting handle spindle is connected with the handle shell in a rotation manner, the speed-adjusting handle spindle is connected with the axle sleeve through a first pin, the axle sleeve is fixedly connected with the button, and the axle sleeve is connected with the stop block in a rotation manner and connected with the handle sleeve.

10 Claims, 13 Drawing Sheets

(51) Int. Cl.

| | |
|---|---|
| ***B63H 20/12*** | (2006.01) |
| ***B63H 20/08*** | (2006.01) |
| ***B63H 20/00*** | (2006.01) |
| ***B63H 23/02*** | (2006.01) |

(52) U.S. Cl.
CPC ..... *B63H 20/12* (2013.01); *B63H 2023/0233* (2013.01)

(58) Field of Classification Search
CPC ..... B63H 21/21; B63H 21/213; B63H 2021/216; B63H 21/22; B63H 2023/0233; B63H 2025/024
See application file for complete search history.

(56) References Cited

U.S. PATENT DOCUMENTS

| | | | | |
|---|---|---|---|---|
| 6,491,555 | B2 * | 12/2002 | Kitsu | B63H 21/22 440/87 |
| 6,884,132 | B2 * | 4/2005 | Okabe | B63H 20/12 440/84 |
| 7,160,160 | B2 * | 1/2007 | Kojima | B63H 20/10 114/144 R |
| 9,422,045 | B2 * | 8/2016 | Kinpara | G05G 5/20 |
| 2015/0232162 | A1 | 8/2015 | Kinpara et al. | |

FOREIGN PATENT DOCUMENTS

| | | | |
|---|---|---|---|
| CN | 202080427 | U | 12/2011 |
| CN | 104108460 | A | 10/2014 |
| CN | 204137314 | U | 2/2015 |
| CN | 104583071 | | 4/2015 |
| CN | 205293042 | U | 6/2016 |
| CN | 205293045 | U | 6/2016 |
| CN | 205327382 | U | 6/2016 |
| JP | 2012-10I793 | A | 5/2012 |
| JP | 2014-2I3683 | A | 11/2014 |

* cited by examiner

ELECTRIC OUTBOARD MOTOR FOR BOAT

CROSS-REFERENCE TO RELATED APPLICATIONS

This application is a continuation of International Patent Application No. PCT/CN2016/107958 with a filing date of Nov. 30, 2016, designating the United States, now pending, and further claims priority to Chinese Patent Application No. 201610939615.X with a filing date of Oct. 25, 2016. The content of the aforementioned applications, including any intervening amendments thereto, are incorporated herein by reference.

TECHNICAL FIELD

The disclosure relates to the technical field of outboard motors for boats, and specifically pertains to an electric outboard motor for a boat.

BACKGROUND OF THE PRESENT INVENTION

At present, control handles of most outboard motors for boats have two speed control manners: first, a speed of a ship body of a motor is controlled in a sensor by adopting mechanical transmission, in such a way, the structure is relatively complicated, reliability is poor, and installation and maintenance are relatively tedious; second, in the prior art, a control handle assembly includes a rotary handle, a connection handle, as connection pole and a potentiometer; through manipulation of the rotation of the rotary handle, the rotary handle drives the connection pole to rotate, the connection pole controls the potentiometer to change a resistance, and then a running speed of the ship body is controlled through the controller, but, this structure has a certain defect during the use, that is, one hand of an operator needs to rotate the rotary handle, and the other hand also needs to tightly hold the connection handle, or else, the entirety will generate a movement phenomenon, and misoperation is easily caused, so that safety is reduced.

SUMMARY OF PRESENT INVENTION

It is an object of the disclosure to provide an electric outboard motor for a boat, which is good in maneuverability and difficultly generates misoperation, so as to overcome the defects of the prior art.

In order to realize the above object, the technical solution of the disclosure is as follows: an electric outboard motor for a boat includes a main body, a motor, a motor controller, a motor mounting case, a paddle, a paddle shaft, a speed-adjusting handle assembly and a main body overturning locking mechanism;

the motor mounting case is mounted on the main body, the motor and the motor controller are arranged inside the motor mounting case, and the motor is electrically connected with the motor controller, one end of the paddle shaft is arranged in the main body, the other end extends out of the main body and is sleeved with the paddle, and the motor shaft of the motor is in transmission connection with one end of the paddle shaft through a transmission component;

the speed-adjusting handle assembly is hinged on the motor mounting case, the speed-adjusting handle assembly includes a handle shell, a potentiometer and a potentiometer mounting board, the potentiometer and the potentiometer mounting board are both arranged in the handle shell, the potentiometer is electrically connected with the motor controller, and the potentiometer is mounted on the potentiometer mounting board;

the main body overturning, locking mechanism includes a spindle mounting base, a mounting hook and a first spindle, and the spindle mounting base is connected with the main body in a rotation manner through the first spindle;

innovation points are as follows:

the speed-adjusting handle assembly further includes a speed-adjusting handle spindle, an axle sleeve, a handle sleeve, a button, a spring and a stop block;

one end of the handle shell is fixedly connected with the stop block, and the handle sleeve abuts against a stepped face of the stop block, the speed-adjusting handle spindle is arranged in the handle shell and connected with the handle shell in a rotation manner, one end of the speed-adjusting handle spindle is inserted into one end of the axle sleeve and connected with the axle sleeve through a first pin, the other end of the axle sleeve is fixedly connected with the button, and the axle sleeve is connected with the stop block in a rotation manner and the axle sleeve is connected with the handle sleeve through a second pin;

a potentiometer adjusting pole axle hole is defined on the other end of the speed-adjusting handle spindle, the adjusting pole of the potentiometer is inserted into the potentiometer adjusting pole axle hole of the speed-adjusting handle spindle, the spring is sleeved at the periphery of the speed-adjusting handle spindle, and one end of the spring abuts against an axle bumper on the speed-adjusting handle spindle or a collar arranged on the speed-adjusting handle spindle, and the other end abuts against one end of the axle sleeve;

a radial limit slot and an axial stop projection are defined on an end surface of one end of the stop block, the first pin abuts against the limit slot of the stop block, the handle sleeve is rotated after the button is pushed, and the first pin is disengaged from the limit slot of the stop block and can abut against the stop projection.

In the above technical solution, the speed-adjusting handle assembly further includes a connection pole and a connection pole base, the other end of the handle shell is fixedly connected with one end of the connection pole, the other end of the connection pole and the connection pole base are fixedly connected or integrated, and the connection pole base is fixedly connected with the motor mounting case, or hinged with the motor mounting case through a double-lug hinge support.

In the above technical solution, the speed-adjusting handle spindle of the speed-adjusting handle assembly has a first connection hole, and the first pin penetrates through the pin hole of the axle sleeve and the first connection hole of the speed-adjusting handle spindle; the axle sleeve has a second connection hole, and the second pin penetrates through the pin hole of the handle sleeve and the second connection hole of the axle sleeve; both of the first connection hole and the second connection hole are oval-shaped connection holes or elongated connection holes.

In the above technical solution, the speed-adjusting handle spindle is connected with the handle shell in a rotation manner through a first bearing; the other end of the inner hole of the stop block has a second bearing slot, a second bearing is arranged in the second bearing slot of the stop block, and the axle sleeve is connected with the stop block in a rotation manner through the second bearing.

In the above technical solution, the main body overturning locking mechanism further includes a stop lever, a first bolt, a first spring, a second bolt, a second spring and a second spindle; the spindle mounting base includes a spindle mounting bushing, the spindle mounting bushing being provided with a mounting book connection base and a locking base which are separately arranged; the spindle mounting bushing is sleeved at the periphery of the first spindle, the mounting hook is connected with the mounting hook connection base of the spindle mounting base in a rotation manner through the second spindle; the mounting hook connection base of the spindle mounting base has a first bolt bushing, the first bolt is inserted into the first bolt bushing and abuts against the second spindle, the first bolt has a first axle bumper, the first spring is sleeved at the periphery of the first bolt, and one end of the first spring abuts against the inner wall of the first bolt bushing, the other end abuts against the first axle bumper of the first bolt, and the second spindle has the radial pin hole; the locking base has a locking groove and the bottom thereof is provided with a second bolt bushing, the second bolt is inserted into the second bolt bushing and penetrates through the locking groove, the second bolt has a second axle bumper, the second spring is sleeved at the periphery of the second bolt and one end of the second spring abuts against the inner wall of the second bolt bushing, the other end abuts against the second axle bumper of the second bolt, and the stop lever is arranged on the mounting hook, penetrates through the locking groove and is located at the inner side of the second bolt; the second bolt is pulled downwardly, the main body can rotate around the second spindle, and the first bolt is inserted into the radial lock hole of the second spindle to enable the main body to rotate around the second spindle to be locked.

In the above technical solution, a mounting hook connection plate of the spindle mounting base has a second spindle bushing, the top of the second spindle bushing is provided with a first bolt bushing, the second spindle penetrates through the second spindle bushing, the mounting hook is fixedly connected with the second spindle, and two ends of the second spindle are equipped with locking nuts.

In the above technical solution, the mounting hook includes two hook plates namely a first hook plate and a second hook plate, and the first hook plate and the second hook plate are fixedly connected by a pin roll.

In the above technical solution, the first hook plate is provided with a plurality of first stop lever holes, the second hook plate is provided with a plurality of second stop lever holes, and the first stop lever holes on the first hook plate are in one-to-one correspondence to the second stop lever holes on the second hook plate, and the stop lever penetrates through the first stop lever holes on the first hook plate and the second stop lever holes on the second hook plate.

In the above technical solution, the spindle mounting bushing is provided with a pin hole, the first spindle is provided with plurality of locking through separately distributed along an axial direction thereof, the main body has a first support arm and a second support arm, the first spindle is mounted on the first support arm and the second support arm, the height of the first spindle between the first support arm and the second support arm is larger than a height of the spindle mounting bushing, and the pin roll penetrates through the pin hole of the spindle mounting bushing and the locking through hole of the first spindle to fixedly connect the spindle mounting bushing with the first spindle.

In the above technical solution, the motor mounting case includes a motor mounting base and a housing, the motor mounting base is mounted on the inner wall of the main body, a height adjusting bracket is arranged at the position of the main body located under the motor mounting base, the height adjusting bracket is provided with a height adjusting screw, and one end of the height adjusting screw abuts against the motor mounting base; the transmission component is arranged in the main body, and the transmission component includes a driving belt wheel, a driven belt wheel and a transmission belt; the motor shaft of the motor is equipped with the driving belt wheel, one end of the paddle shall is equipped with the driven belt wheel, and the driving belt wheel is in transmission connection with the driven belt wheel through the transmission belt; both of the driving belt wheel and the driven belt wheel are pulleys, and the transmission belt is a leather belt, or both of the driving belt wheel and the driven belt wheel are synchronous pulleys, and the transmission belt is a synchronous belt.

The disclosure has the disadvantages that after the electric outboard motor for the boat of the disclosure is adopted, since the disclosure further includes the speed-adjusting handle spindle, the axle sleeve, the handle sleeve, the button, the spring and the stop block; one end of the handle shell is fixedly connected with the stop block, and the handle sleeve abuts against the stepped surface of the stop block, the speed-adjusting handle spindle is arranged in the handle shell and connected with the handle shell in a rotation manner, one end of the speed-adjusting handle spindle is inserted into end of the axle sleeve and connected with the axle sleeve through the first pin, the other end of the axle sleeve is fixedly connected with the button, the axle sleeve is connected with the stop block in a rotation manner, and the axle sleeve is connected with the handle sleeve through the second pin; the potentiometer adjusting pole axle hole is defined on the other end of the speed-adjusting handle spindle, the adjusting pole of the potentiometer is inserted into the potentiometer adjusting pole axle hole of the speed-adjusting handle spindle, the spring is sleeved at the periphery of the speed-adjusting handle spindle, and one end of the spring abuts against the axle bumper on the speed-adjusting handle spindle or collar arranged on the speed-adjusting handle spindle, and the other end abuts against one end of the axle sleeve; a radial limit slot and an axial stop projection are defined on the end surface of one end of the stop block, the first pin abuts against the limit slot of the stop block, the handle sleeve is rotated after the button is pushed, and the first pin is disengaged from the limit slot of the stop block and can abut against the stop projection; when the electric outboard motor for the boat is used, the operator only needs one hand to hold the handle sleeve, and pushes the button with a thumb so that the axle sleeve axially moves, and then the first pin is disengaged from the limit slot of the stop block, at this moment, the spring is in a compression state, the handle sleeve is swirled, the handle sleeve drives the axle sleeve to rotate through the second pin, the axle sleeve drives the speed-adjusting handle spindle to rotate through the first pin, and the axle sleeve drives the potentiometer to rotate, so that the speed-adjusting handle spindle controls the potentiometer to change the resistance, the running speed of the ship body is controlled through the motor controller, the running direction of the ship body is also changed when the handle sleeve is radially pushed, since the first pin abuts against the limit slot of the stop block, misoperation can be effectively prevented, when the button is reset, the axle sleeve axially moves again depending on an elastic force of the spring so that the first pin abuts against the limit slot of the stop block again, at this moment, the axle sleeve cannot rotate. Thus, the electric outboard motor for the boat provided by the disclosure not only is good in maneuverability but also difficultly generates misoperation.

DETAILED DESCRIPTION OF PREFERRED EMBODIMENTS

Figure 1:
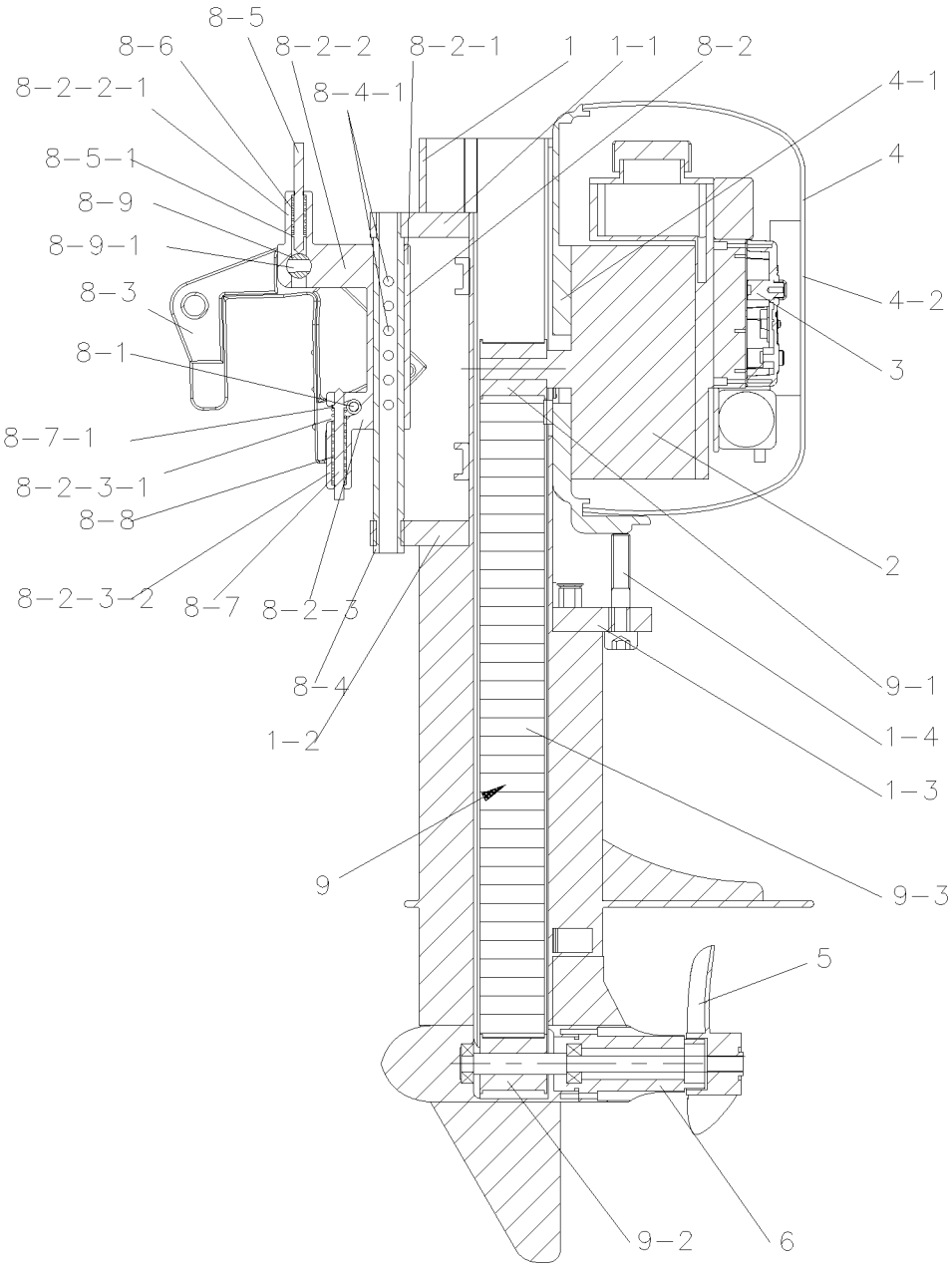
FIG. 1 is a structural diagram according to an embodiment of the disclosure.
Figure 2:
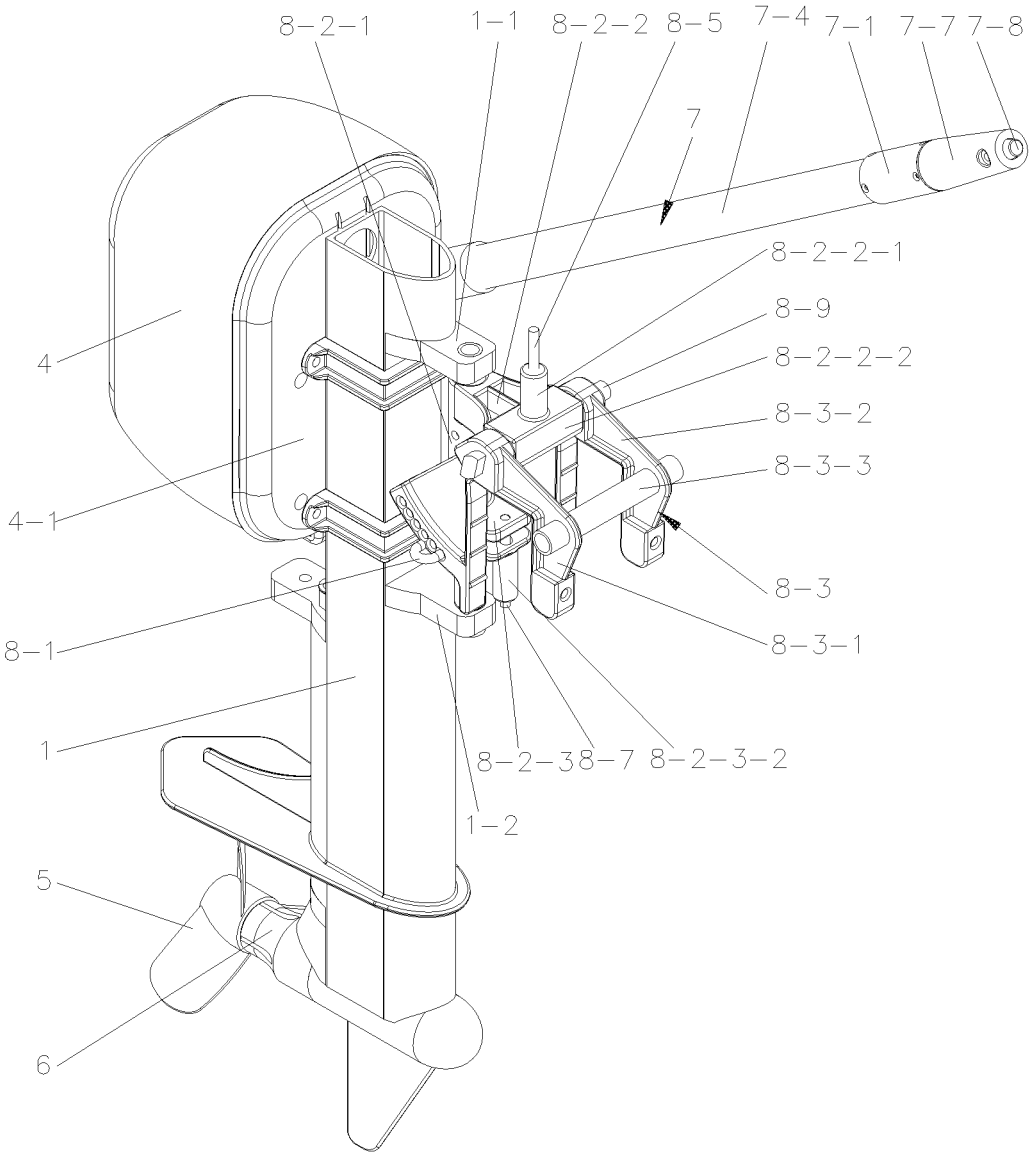
FIG. 2 is a three-dimensional structural diagram according to the disclosure.
Figure 3:
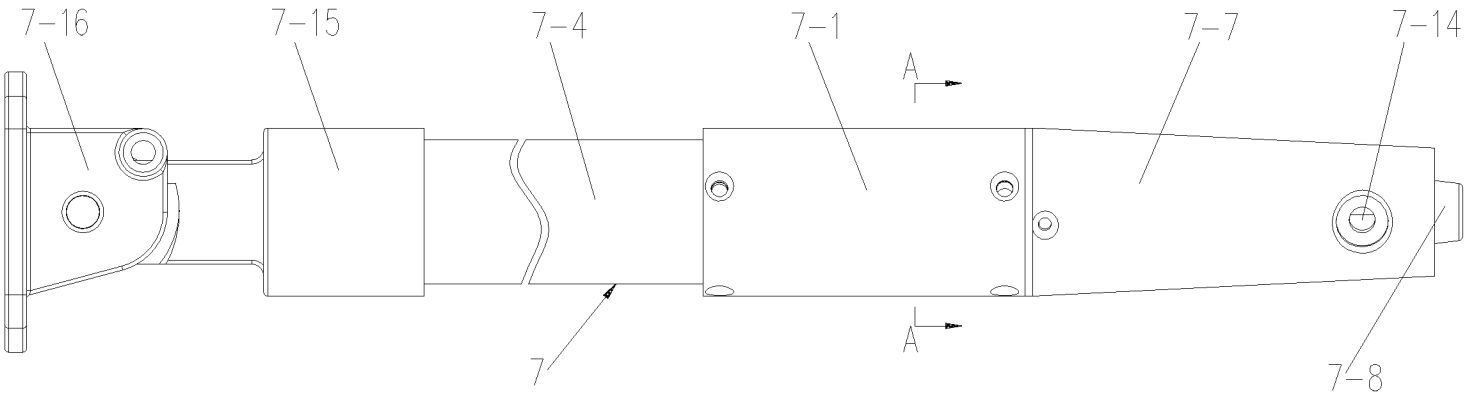
FIG. 3 is a front view of a speed-adjusting handle assembly according to the disclosure.
Figure 4:
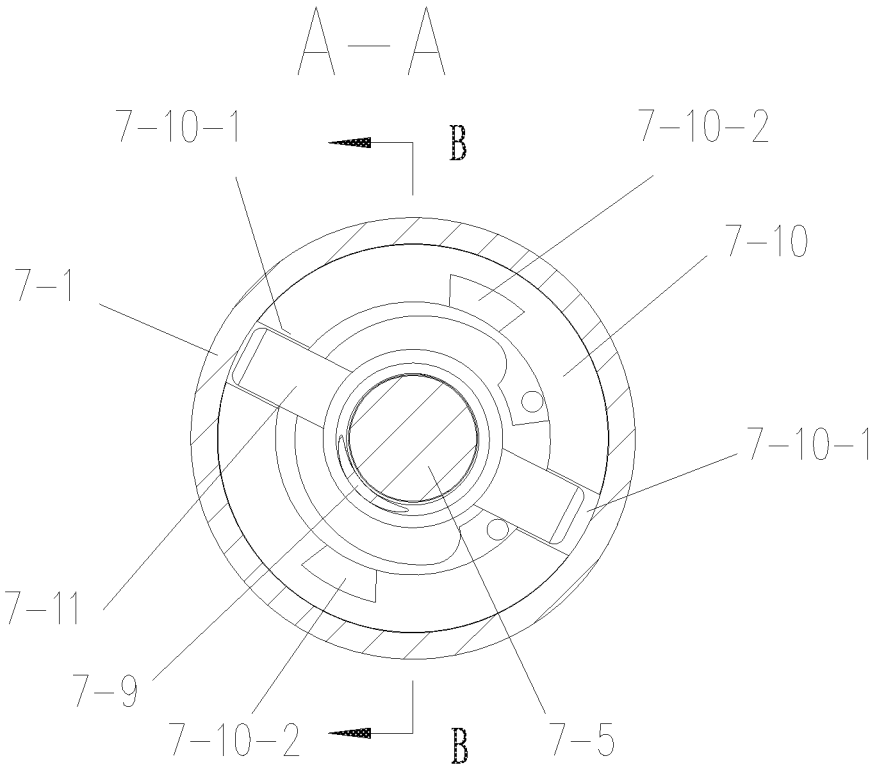
FIG. 4 is a cross-sectional view taken along a line A-A of FIG. 3.

Next, the disclosure will be further described in combination with accompanying drawings and given embodiments, but is not limited thereto.

As illustrated in FIGS. 1-14, an electric outboard motor for a boat includes a main body 1, a motor 2, a motor controller 3, a motor mounting case 4, a paddle 5, a paddle shaft 6, a speed-adjusting handle assembly 7 and a main body overturning locking mechanism 8.

The motor mounting case 4 is mounted on the main body 1, the motor 2 and the motor controller 3 are arranged inside the motor mounting case 4, and the motor 2 is electrically connected with the motor controller 3, one end of the paddle shaft 6 is arranged in the main body 1, the other end extends out of the main body 1 and is sleeved with the paddle 5, and the motor shaft of the motor 2 is in transmission connection with one end of the paddle shaft 6 through a transmission component 9.

The speed-adjusting handle assembly 7 is hinged on the motor mounting case 4, the speed-adjusting handle assembly 7 includes a handle shell 7-1, a potentiometer 7-2 and a potentiometer mounting board 7-3, the potentiometer 7-2 and the potentiometer mounting board 7-3 are both arranged in the handle shell 7-1, the potentiometer 7-2 is electrically connected with the motor controller 3, and the potentiometer 7-2 is mounted on the potentiometer mounting board 3.

The main body overturning locking mechanism 8 includes a spindle mounting base 8-2, a mounting hook 8-3 and a first spindle 8-4, and the spindle mounting base 8-2 is connected with the main body 1 in a rotation manner through the first spindle 8-4.

The speed-adjusting handle assembly 7 further includes a speed-adjusting handle spindle 7-5, an axle sleeve 7-6, a handle sleeve 7-7, a button 7-8, a spring 7-9 and a stop block 7-10.

One end of the handle shell 7-1 is fixedly connected with the stop block 7-10, and the handle sleeve 7-7 abuts against a stepped face of the stop block 7-10, the speed-adjusting handle spindle 7-5 is arranged in the handle shell 7-1 and connected with the handle shell 7-1 in a rotation manner, one end of the speed-adjusting spindle 7-5 is inserted into one end of the axle sleeve 7-6 and connected with the axle sleeve 7-6 through a first pin 7-11, the other end of the axle sleeve 7-6 is fixedly connected with the button 7-8, the axle sleeve 7-6 is connected with the stop block 7-10 in a rotation manner, and the axle sleeve 7-6 is connected with the handle sleeve 7-7 through a second pin 7-14.

A potentiometer adjusting pole axle hole 7-5-1 is defined on the other end of the speed-adjusting handle spindle 7-5, the adjusting pole of the potentiometer 7-2 is inserted into the potentiometer adjusting pole axle hole 7-5-1 of the speed-adjusting handle spindle 7-5, the spring 7-9 is sleeved at the periphery of the speed-adjusting handle spindle 7-5, and one end of the spring 7-9 abuts against an axle bumper 7-5-2 on the speed-adjusting handle spindle 7-5 or a collar arranged on the speed-adjusting handle spindle 7-5, and the other end abuts against one end of the axle sleeve 7-6.

A radial limit slot 7-10-1 and an axial stop projection 7-10-2 are defined on the end surface of one end the stop block 7-10, the first pin 7-11 abuts against the limit slot 7-10-1 of the stop block 7-10, the handle sleeve 7-7 is rotated after the button 7-8 is pushed, and the first pin 7-11 is disengaged from the limit slot 7-10-1 of the stop block 7-10 and can abut against the stop projection 7-10-2.

As illustrated in FIGS. 2, 3, 5 and 10, in order to conveniently equip the electric outboard motor for the boat with the motor mounting base 4 of the outboard machine so that the structure is more reasonable, the speed-adjusting handle assembly 7 further includes a connection pole 7-4 and a connection pole base 7-15, the other end of the handle shell 7-1 is fixedly connected with one end of the connection pole 7-4, the other end of the connection pole 7-4 and the connection pole base 7-15 are fixedly connected or integrated, and the connection pole base 7-15 is fixedly connected with the motor mounting case 4, or hinged with the motor mounting case 4 through a double-lug hinge support 7-16. The connection pole base 7-15 is hinged with the motor mounting case 4, or the connection pole base 7-15 is hinged with the motor mounting case 4 through the double-lug support 7-16 and the double-lug support 7-16 is fixedly connected with the motor mounting case 4.

Figure 5:
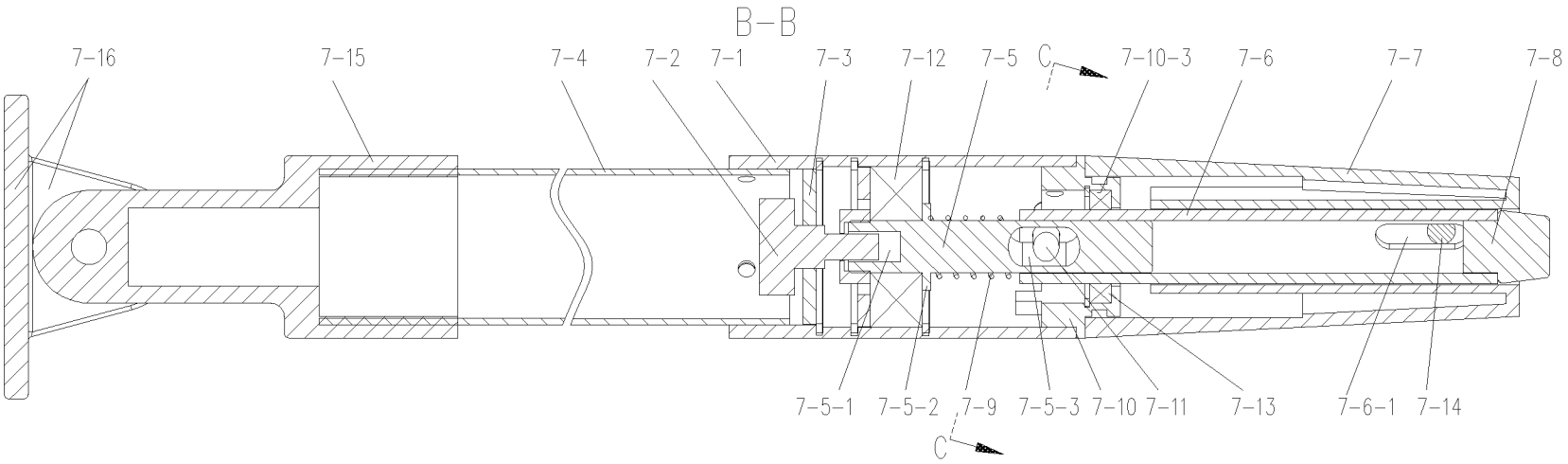
FIG. 5 is a cross-sectional view taken along a line B-B of FIG. 4.
Figure 6:
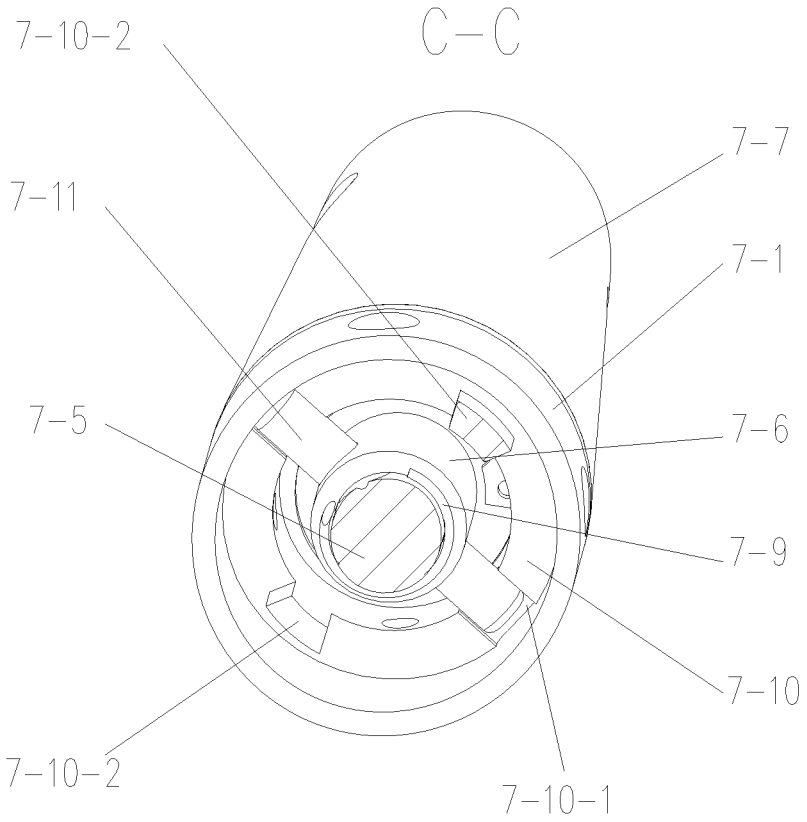
FIG. 6 is a cross-sectional view taken along a line C-C of FIG. 5.
Figure 7:
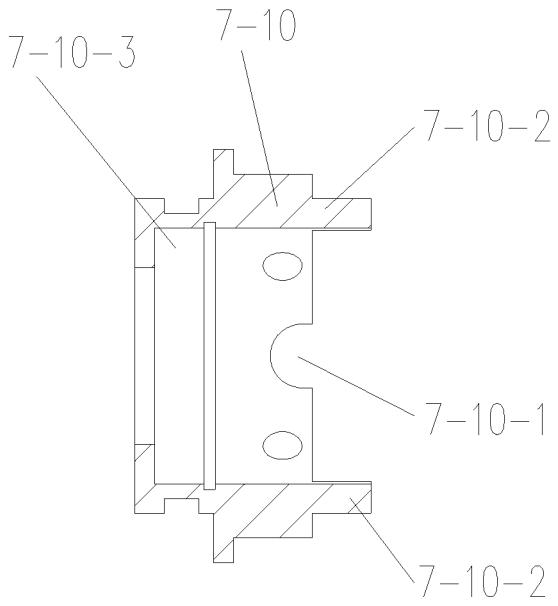
FIG. 7 is a structural diagram of a stop block according to the disclosure.
Figure 8:
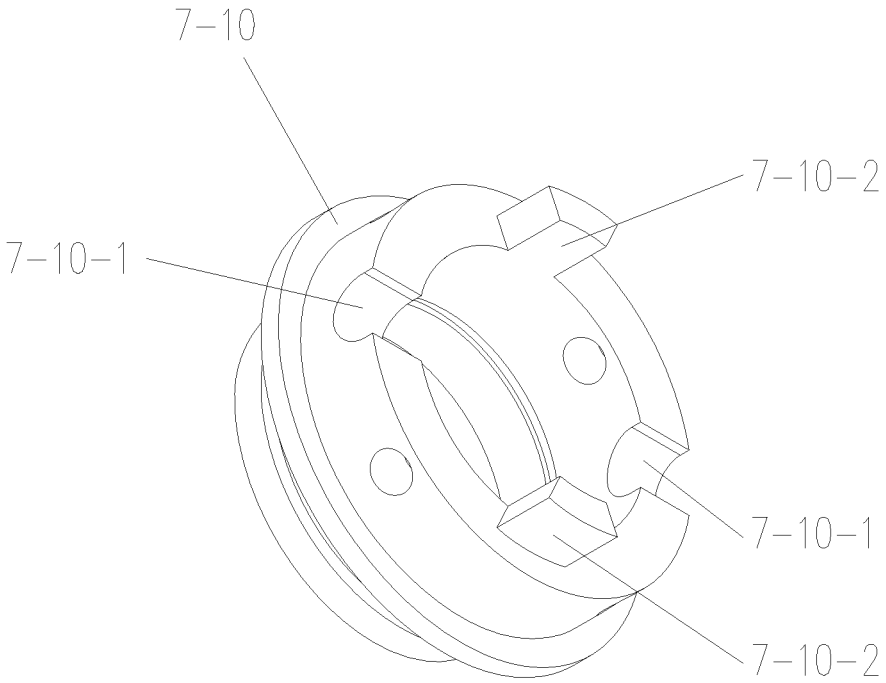
FIG. 8 is a three-dimensional structural diagram of a stop block according to the disclosure.
Figure 9:
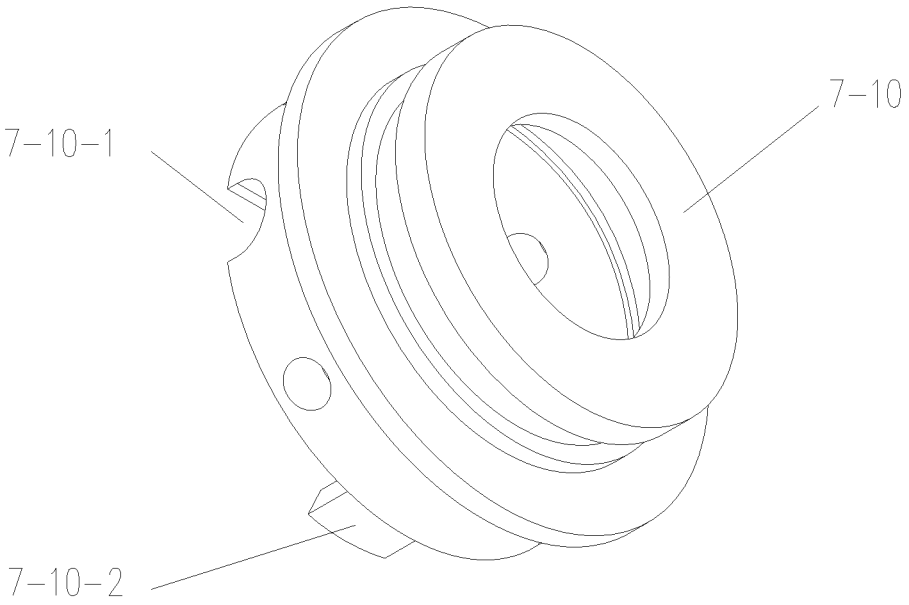
FIG. 9 is a diagram of FIG. 8 in an another direction.
Figure 10:
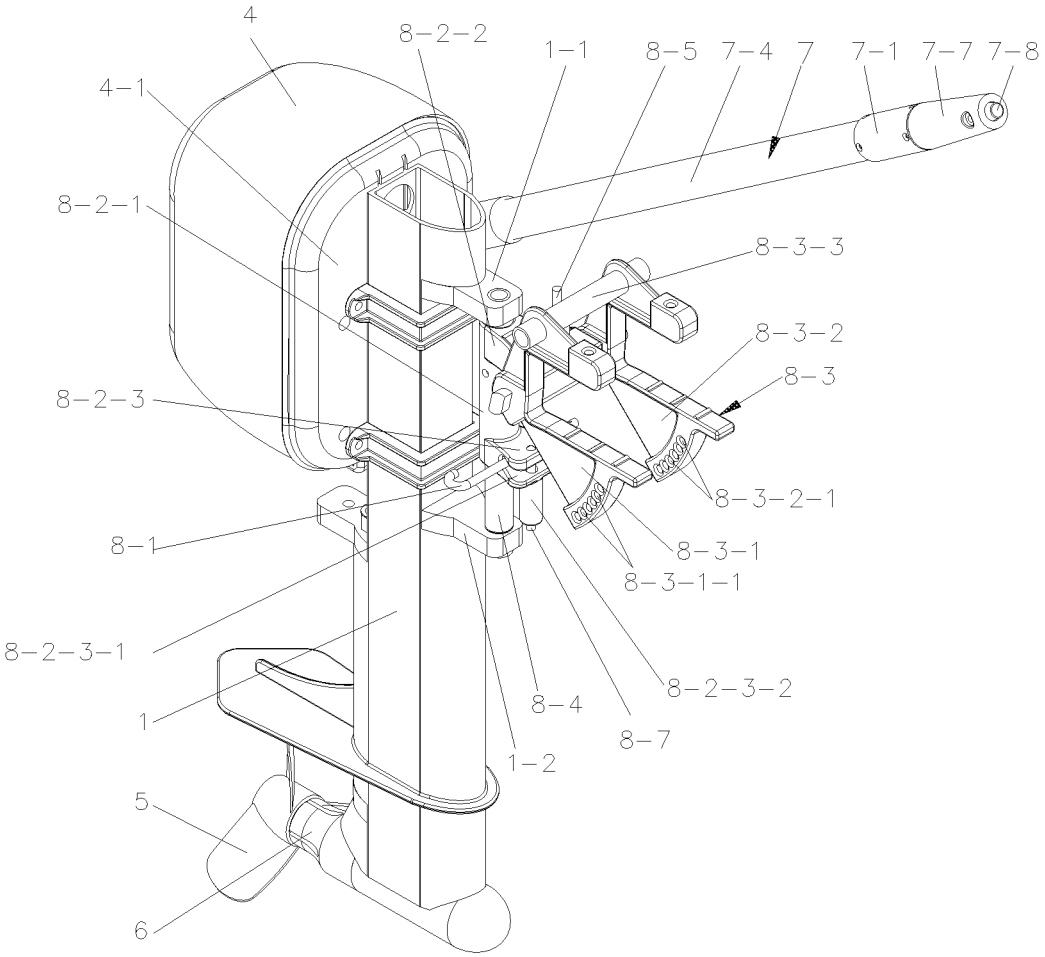
FIG. 10 is an another state diagram of FIG. 2 (a mounting hook overturns)

As illustrated in FIG. 5, in order to conveniently move the speed-adjusting handle spindle 7-5 and the axle sleeve 7-6, the speed-adjusting handle spindle 7-5 of the speed-adjusting handle assembly 7 has a first connection hole 7-5-3, and the first pin 7-11 penetrates through the pin hole of the axle sleeve 7-6 and the first connection hole 7-5-3 of the speed-adjusting handle spindle 7-5; the axle sleeve 7-6 has a second connection hole 7-6-1, and the second pin 7-14 penetrates through the pin hole of the handle sleeve 7-7 and the second connection hole 7-6-1 of the axle sleeve 7-6; both of the first connection hole 7-5-3 and the second connection hole 7-6-1 are oval-shaped connection holes or elongated connection holes.

As illustrated in FIG. 5, in order to further improve the stationarity of rotation of speed-adjusting handle spindle 7-5 and the axle sleeve 7-6 and in order to conveniently mount a second bearing 13, the speed-adjusting handle spindle 7-5 is connected with the handle shell 7-1 in a rotation manner through a first bearing 7-12; the other end of the inner hole of the stop block 7-10 has a second bearing slot 7-10-3, the second bearing 7-13 is arranged in the second bearing slot 7-10-3 of the stop block 7-10, and the axle sleeve 7-6 is connected with the stop block 7-10 in a rotation manner through the second bearing 7-13.

As illustrated in FIGS. 1, 2, 10, 11, 12, 13 and 14, in order to overturn and lock the main body and prevent the main body from being eroded by river water, the main body overturning locking mechanism 8 further includes a stop lever 8-1, a first bolt 8-5, a first spring 8-6, a second bolt 8-7, a second spring 8-8 and a second spindle 8-9.

The spindle mounting base 8-2 includes a spindle mounting bushing 8-2-1, the spindle mounting bushing 8-2-1 being provided with a mounting hook connection base 8-2-2 and a locking base 8-2-3 which are separately arranged; the spindle mounting bushing 8-2-1 is sleeved at the periphery of the first spindle 8-4, the mounting hook 8-3 is connected with the mounting hook connection base 8-2-2 of the spindle mounting base 8-2 in a rotation manner through the second spindle 8-9.

The mounting hook connection base 8-2-2 of the spindle mounting base 8-2 has a first bolt bushing 8-2-2-1, the first bolt 8-5 is inserted into the first bolt bushing 8-2-2-1 and abuts against the second spindle 8-9, the first bolt 8-5 has a first axle bumper 8-5-1, the first spring 8-6 is sleeved at the periphery of the first bolt 8-5, and one end of the first spring 8-6 abuts against the inner wall of the first bolt bushing 8-2-2-1, the other end abuts against the first axle bumper 8-5-1 of the first bolt 8-5, and the second spindle 8-9 has the radial pin hole 8-9-1.

The locking base 8-2-3 has a locking groove 8-2-3-1 and the bottom thereof is provided with a second bolt bushing 8-2-3-2, the second bolt 8-7 is inserted into the second bolt bushing 8-2-3-2 and penetrates through the locking groove 8-2-3-1, the second bolt 8-7 has a second axle bumper 8-7-1, the second spring 8-6 is sleeved at the periphery of the second bolt 8-7 and one end of the second spring 8-6 abuts against the inner wall of the second bolt bushing 8-2-3-2, the other end abuts against the second axle bumper 8-7-1 of the second bolt 8-7, and the stop lever 8-1 is arranged on the mourning hook 8-3, penetrates through the locking groove 8-2-3-1 and is located at the inner side of the second bolt 8-7.

The second bolt 8-7 is pulled downwardly, the main body 1 can rotate around the second spindle 8-9, and the second bolt 8-5 is inserted into the radial lock hole 8-9-1 of the second spindle 8-9 to enable the main body 1 to rotate around the second spindle 8-9 to be locked.

Figure 11:
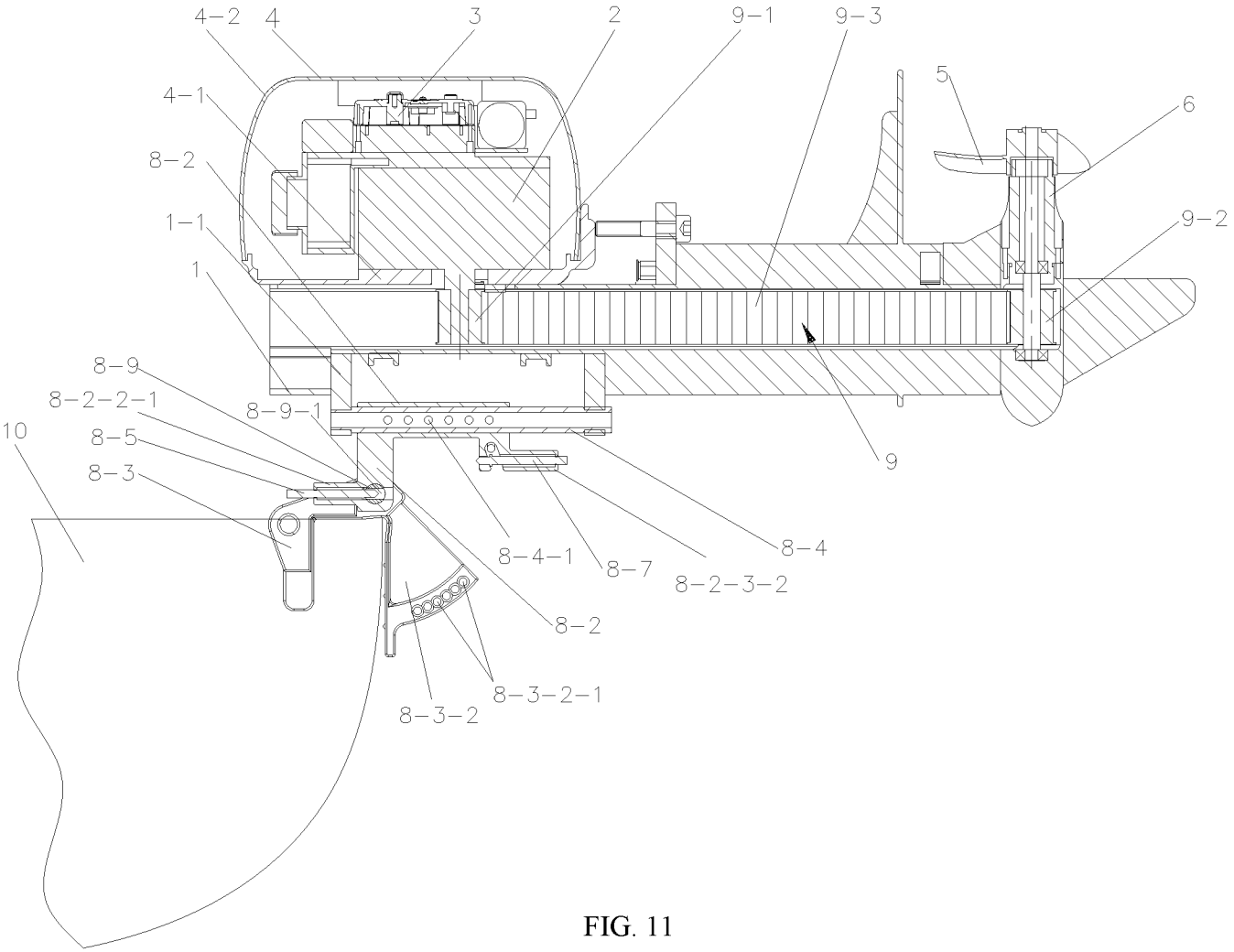
FIG. 11 is a structural diagram of a main body when in use after overturning locking according to the disclosure.
Figure 12:
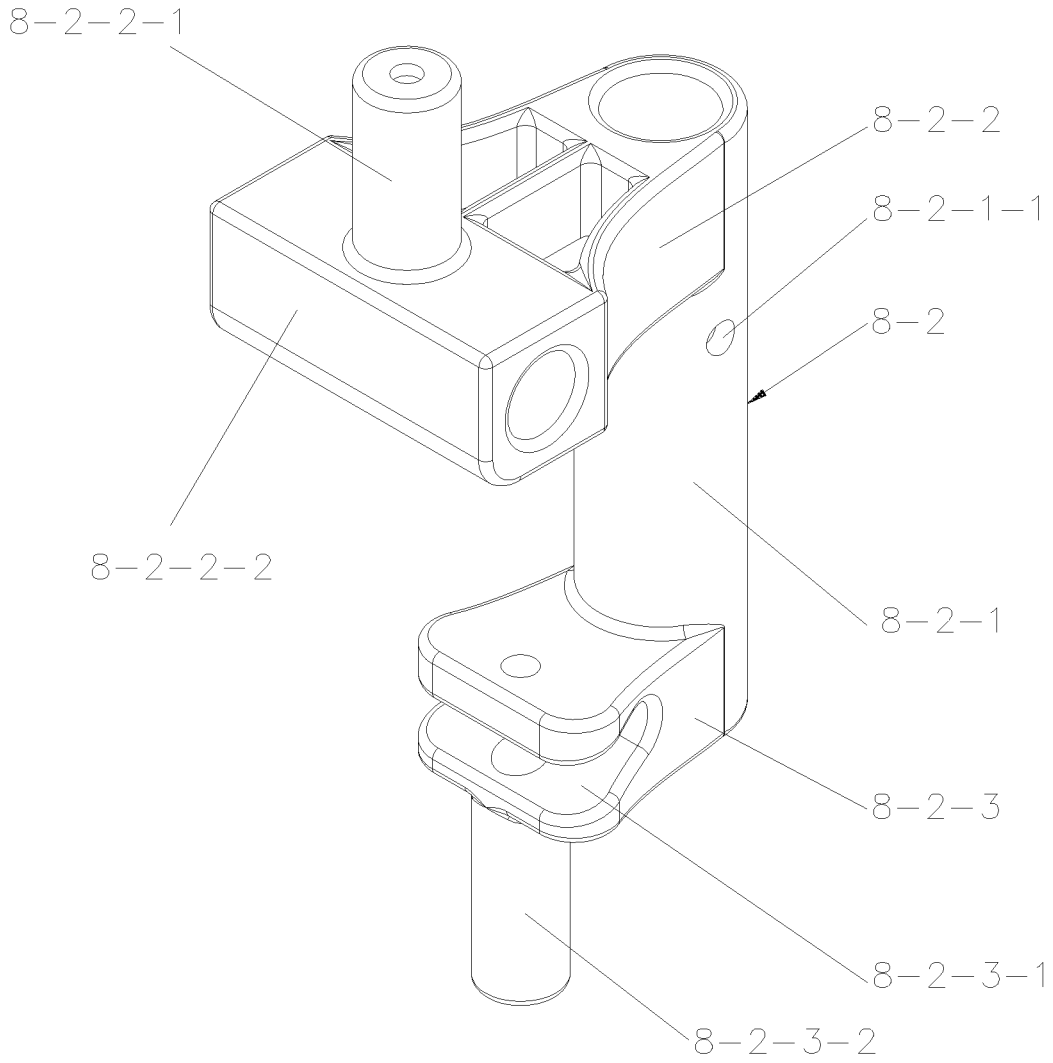
FIG. 12 is a three-dimensional structural diagram of a spindle mounting base according to the disclosure.
Figure 13:
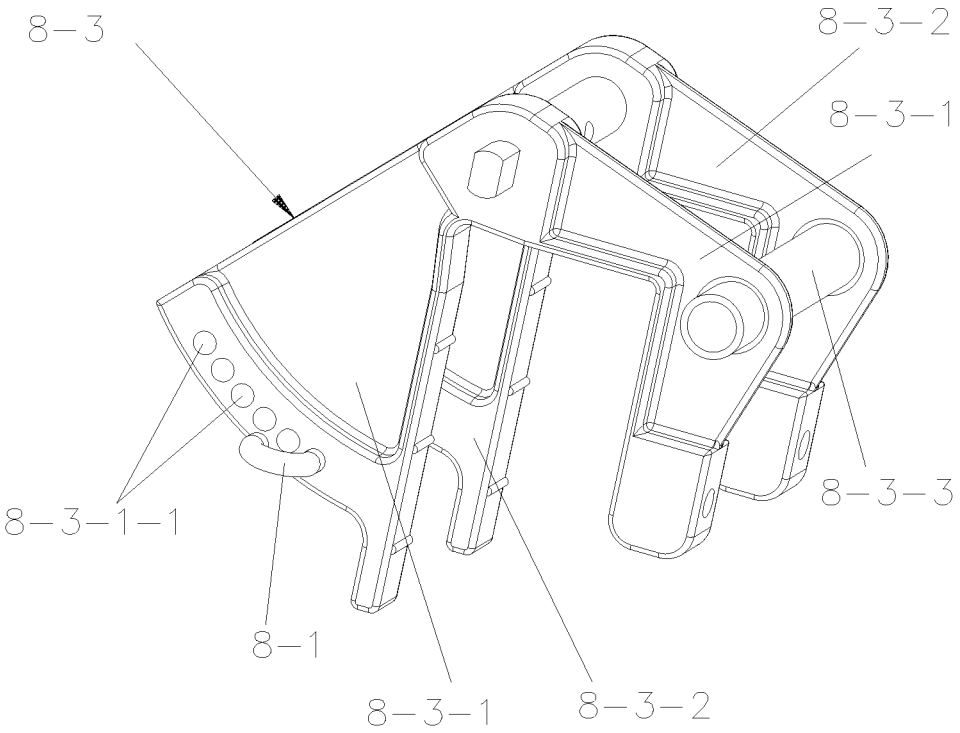
FIG. 13 is a three-dimensional structural diagram of a mounting hook according to the disclosure.
Figure 14:
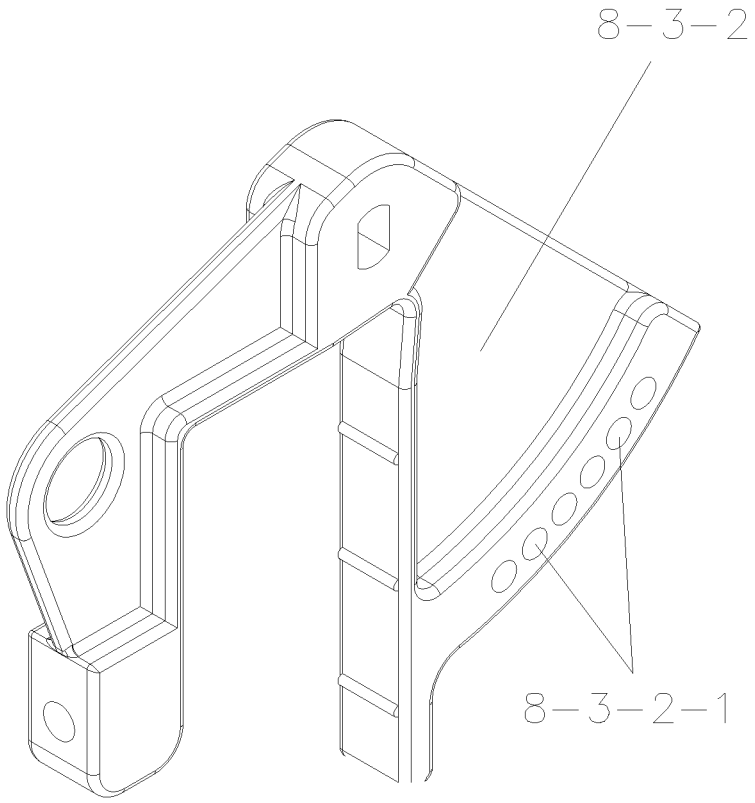
FIG. 14 is a three-dimensional structural diagram of one hook plate of a mourning hook according to the disclosure.

As illustrated in FIGS. 1 and 11, the mounting hook 8-3 of the disclosure is hung on a tail hoard of a ship body 10, when the electric outboard motor for the boat is used, the second bolt 8-7 penetrates through the locking groove 8-2-3-1 of the locking base 8-2-3, the stop lever 8-1 penetrates through the locking groove 8-2-3-1 to be located at the inner side of the second bolt 8-7; when the electric outboard motor for the boat is not used, the second bolt 8-7 is pulled downwardly, the main body 1 can rotate around the second spindle 8-9, at this moment, the first bolt 8-5 is inserted into the radial lock hole 8-9-1 of the second spindle 8-9 to enable the main body 1 to overturn around the second spindle 8-9 to be locked, thereby effectively preventing a situation that the main body is invaded into the river to be eroded so that the electric outboard motor for the boat is long in service life.

As illustrated in FIGS. 1, 2, 10, 11 and 12, in order to conveniently equip the second spindle 8-9 with the mounting hook connection plate 8-2-2, a mounting hook connection plate 8-2-2 of the spindle mounting base 8-2 has a second spindle bushing 8-2-2-2, the top of the second spindle bushing 8-2-2-2 is provided with a first bolt bushing 8-2-2-1, the second spindle 8-9 penetrates through the second spindle bushing 8-2-2-2, the mounting hook 8-3 is fixedly connected with the second spindle 8-9, and two ends of the second spindle 8-9 are equipped with locking nuts.

As illustrated in FIGS. 1, 2, 10, 11, 13 and 14, in order to make the structure of the electric outboard motor for the boat of the disclosure more reasonable and conveniently hang on the tail board of the ship body, the mounting hook 8-3 includes two hook plates namely a first hook plate 8-3-1 and a second book plate 8-3-2, and the first hook plate 8-3-1 and the second hook plate 8-3-2 are fixedly connected by a pin roll 8-3-3.

As illustrated in FIGS. 2, 10, 11, 13 and 14, in order to conveniently adjust an included angle between the electric outboard motor for the boat and the ship body and conveniently push the running of the ship body, when in use, according to demand of the running of the ship body 10, the stop lever 8-1 penetrates through corresponding stop lever holes on the first hook plate 8-3-1 and the second hook plate 8-3-2, the first hook plate 8-3-1 is provided with a plurality of first stop lever holes 8-3-1-1, the second hook plate 8-3-2 is provided with a plurality of second stop lever holes 8-3-2-1, and the first stop lever holes 8-3-1-1 on the first hook plate 8-3-1 are in one-to-one correspondence to the second stop lever holes 8-3-2-1 on the second hook plate 8-3-2-1, and the stop lever 8-1 penetrates through the first stop lever holes 8-3-1-1 on the first hook plate 8-3-1 and the second stop lever holes 8-3-2-1 on the second hook plate 8-3-2.

As illustrated in FIGS. 1, 2, 10 and 11, in order that the electric outboard motor for the boat is suitable for rivers having different water surface heights, when in use, the main body 1 moves upwardly, then pass through the pin hole 8-2-1-1 of the spindle mounting bushing 8-2-1 and penetrates through corresponding locking through holes 8-4-1 on the first spindle 8-4, the spindle mounting bushing 8-2-1 is provided with a pin hole 8-2-1-1, the first spindle 8-4 is provided with a plurality of locking through holes 8-4-1 separately distributed along an axial direction thereof, the main body 1 has a first support arm 1-1 and a second support arm 1-2, the first spindle 8-4 is mounted on the first support arm 1-1 and the second support arm 1-2, the height of the first spindle 8-4 between the first support arm 1-1 and the second support arm 1-2 is larger than a height of the spindle mounting bushing 8-2-1, and the pin roll penetrates through the pin hole 8-2-1-1 of the spindle mounting bushing 8-2-1 and the locking through hole 8-4-1 of the first spindle 8-4 to fixedly connect the spindle mounting bushing 8-2-1 with the first spindle 8-4.

As illustrated in FIGS. 1 and 11, the motor mounting case 4 includes a motor mounting base 4-1 and a housing 4-2, the motor mounting base 4-1 is mounted on the inner wall of the main body 1, a height adjusting bracket 1-3 is arranged at the position of the main body 1 located under the motor mounting base 4-1, the height adjusting bracket 1-3 is provided with a height adjusting screw 1-4, and one end of the height adjusting screw 1-4 abuts against the motor mounting base 4-1; the transmission component 9 is arranged in the main body 1 and the transmission component 9 includes a driving belt wheel 9-1, a driven belt wheel 9-2 and a transmission belt 9-3; the motor shaft of the motor 2 is equipped with the driving belt wheel 9-1, one end of the paddle shaft 6 is equipped with the driven belt wheel 9-2, and the driving belt wheel 9-1 is in transmission connection with the driven belt wheel 9-2 through the transmission belt 9-3; both of the driving belt wheel 9-1 and the driven belt wheel 9-2 are pulleys, and the transmission belt 9-3 is a leather belt, or both of the driving belt wheel 9-1 and the driven belt wheel 9-2 are synchronous pulleys, and the transmission belt 9-3 is a synchronous belt. According to the disclosure, the motor mounting base 4 is fixed on the outer side wall of the main body 1 so as to replace a structure in the prior art that the motor mounting base is fixed on the top of the main body, in such a way, the electric outboard motor for the boat is more reasonable in structure, the motor shaft of the motor 2 of the disclosure is in transmission connected with the paddle shaft 6 through the driving belt wheel and the transmission belt so as to replace a transmission structure via a spindle or a gear in the prior art, in such a way, production cost is low, and bearing capability is large, the electric outboard motor for the boat is suitable for engines having different powers so that maneuverability is good, and the disclosure also has advantages of small noise and the like.

When the electric outboard motor for the boat of the disclosure is used, an operator only needs one hand to hold the handle sleeve 7-7, and pushes the button 7-8 with a thumb so that the axle sleeve 7-6 axially moves, and then the first pin 7-11 is disengaged from the limit slot 7-10-1 of the stop block 7-10, at this moment, the spring 7-9 is in a compression state, the handle sleeve is swirled, the handle sleeve 7-7 drives the axle sleeve 7-6 to rotate through the second pin 7-14, the axle sleeve 7-6 drives the speed-adjusting handle spindle 7-5 to rotate through the first pin 7-11, and the axle sleeve 7-6 drives the potentiometer 2 to rotate, so that the speed-adjusting handle spindle 7-5 controls the potentiometer 2 to change the resistance, the running speed of the ship body 10 is controlled through the motor controller 3, the running direction of the ship body 10 is also changed when the handle sleeve 7-7 is radially pushed, since the first pin 7-11 abuts against the limit slot 7-10-2 of the stop block 7-10, misoperation can be effectively prevented, when the button 7-8 is reset, the axle sleeve 7-6 axially moves again depending on an elastic force of the spring 7-9 so that the first pin 7-11 abuts against the limit slot 7-10-1 of the stop block 7-10 again, at this moment, the axle sleeve 7-6 cannot rotate. Thus, the electric outboard motor for the boat provided by the disclosure not only is good in maneuverability but also difficultly generates misoperation.

We claim:

1. An electric outboard motor for a boat, comprising a main body (1), a motor (2), a motor controller (3), a motor mounting case (4), a paddle (5), a paddle shaft (6), a speed-adjusting handle assembly (7) and a main body overturning locking mechanism (8);

wherein, the motor mounting case (4) is mounted on the main body (1), the motor (2) and the motor controller (3) are arranged inside the motor mounting case (4), the motor (2) is electrically connected with the motor controller (3), one end of the paddle shaft (6) is arranged in the main body (1), the other end extends out of the main body (1) and is sleeved with the paddle (5), and a motor shaft of the motor (2) is in transmission connection with one end of the paddle shaft (6) through a transmission component (9);

the speed-adjusting handle assembly (7) is hinged on the motor mounting case (4), the speed-adjusting handle assembly (7) includes a handle shell (7-1), a potentiometer (7-2) and a potentiometer mounting board (7-3), the potentiometer (7-2) and the potentiometer mounting board (7-3) are both arranged in the handle shell (7-1), the potentiometer (7-2) is electrically connected with the motor controller (3), and the potentiometer (7-2) is mounted on the potentiometer mounting hoard (7-3);

the main body overturning locking mechanism (8) includes a spindle mounting base (8-2), a mounting hook (8-3) and a first spindle (8-4), and the spindle mounting base (8-2) is connected with the main body (1) in a rotation manner through the first spindle (8-4);

the speed-adjusting handle assembly (7) further includes a speed-adjusting handle spindle (7-5), an axle sleeve (7-6), a handle sleeve (7-7), a button (7-8), a spring (7-9) and a stop block (7-10);

one end of the handle shell (7-1) is fixedly connected with the stop block (7-10), the handle sleeve (7-7) abuts against a stepped face of the stop block (7-10), the speed-adjusting handle spindle (7-5) is arranged in the handle shell (7-1) and connected with the handle shell (7-1) in a rotation manner, one end of the speed-adjusting handle spindle (7-5) is inserted into one end of the axle sleeve (7-6) and connected with the axle sleeve (7-6) through a first pin (7-11), the other end of the axle sleeve (7-6) is fixedly connected with the button (7-8), the axle sleeve (7-6) is connected with the stop block (7-10) in a rotation manner, and the axle sleeve (7-6) is connected with the handle sleeve (7-7) through a second pin (7-14);

a potentiometer adjusting pole axle hole (7-5-1) is defined on the other end of the speed-adjusting handle spindle (7-5), an adjusting pole of the potentiometer (7-2) is inserted into the potentiometer adjusting pole axle hole (7-5-1) of the speed-adjusting handle spindle (7-5), the spring (7-9) is sleeved at the periphery of the speed-adjusting handle spindle (7-5), and one end of the spring (7-9) abuts against an axle bumper (7-5-2) on the speed-adjusting handle spindle (7-5) or a collar arranged on the speed-adjusting handle spindle (7-5), and the other end abuts against one end of the axle sleeve (7-6);

a radial limit slot (7-10-1) and an axial stop projection (7-10-2) are defined on an end surface of one end of the stop block (7-10), the first pin (7-11) abuts against the limit slot (7-10-1) of the stop block (7-10), the handle sleeve (7-7) is rotated after the button (7-8) is pushed, and the first pin (7-11) is disengaged from the limit slot (7-10-1) of the stop block (7-10) and can abut against the stop projection (7-10-2).

2. The electric outboard motor tor the boat according to claim 1, wherein, the speed-adjusting handle assembly (7) further includes a connection pole (7-4) and a connection pole base (7-15), the other end of the handle shell (7-1) is fixedly connected with one end of the connection pole (7-4), the other end of the connection pole (7-4) and the connection pole base (7-15) are fixedly connected or integrated, and the connection pole base (7-15) is fixedly connected with the motor mounting case (4), or hinged with the motor mounting case (4) through a double-lug hinge support (7-16).

3. The electric outboard motor for the boat according to claim 1, wherein, the speed-adjusting handle spindle (7-5) of the speed-adjusting handle assembly (7) has a first connection hole (7-5-3), and the first pin (7-11) penetrates through the pin hole of the axle sleeve (7-6) and the first connection hole (7-5-3) of the speed-adjusting handle spindle (7-5); the axle sleeve (7-6) has a second connection hole (7-6-1), and the second pin (7-14) penetrates through the pinhole of the handle sleeve (7-7) and the second connection hole (7-6-1) of the axle sleeve (7-6); both of the first connection hole (7-5-3) and the second connection hole (7-6-1) are oval-shaped connection holes or elongated connection holes.

4. The electric outboard motor for the boat according to claim 1, wherein, the speed-adjusting handle spindle (7-5) is connected with the handle shell (7-1) in a rotation manner through a first bearing (7-12); the other end of the inner hole of the stop block (7-10) has a second bearing slot (7-10-3), a second bearing (7-13) is arranged in the second bearing slot (7-10-3) of the stop block (7-10), and the axle sleeve (7-6) is connected with the stop block (7-10) in a rotation manner through the second bearing (7-13).

5. The electric outboard motor for the boat according to claim 1, wherein, the main body overturning locking mechanism (8) further includes a stop lever (8-1), a first bolt (8-5), a first spring (8-6), a second bolt (8-7), a second spring (8-8) and a second spindle (8-9);

the spindle mounting base (8-2) includes a spindle mounting bushing (8-2-1), the spindle mounting bushing (8-2-1) is provided with a mounting hook connection base (8-2-2) and a locking base (8-2-3) which are separately arranged; the spindle mounting bushing (8-2-1) is sleeved at the periphery of the first spindle (8-4), the mounting hook (8-3) is connected with the mounting hook connection base (8-2-2) of the spindle mounting base (8-2) in a rotation manner through the second spindle (8-9);

the mounting hook connection base (8-2-2) of the spindle mounting base (8-2) has a first bolt bushing (8-2-2-1), the first bolt (8-5) is inserted into the first bolt bushing (8-2-2-1) and abuts against the second spindle (8-9), the first bolt (8-5) has a first axle bumper (8-5-1), the first spring (8-6) is sleeved at the periphery of the first bolt (8-5), and one end of the first spring (8-6) abuts against an inner wall of the first bolt bushing (8-2-2-1), the other end abuts against the first axle bumper (8-5-1) of the first bolt (8-5), and the second spindle (8-9) has the radial pin hole (8-9-1);

the locking base (8-2-3) has a locking groove (8-2-3-1) and a second bolt bushing (8-2-3-2) is arranged at a bottom of the locking, base (8-2-3), the second bolt (8-7) is inserted into the second bolt bushing (8-2-3-2) and penetrates through the locking groove (8-2-3-1), the second bolt (8-7) has a second axle bumper (8-7-1), the second spring (8-6) is sleeved at the periphery of the second bolt (8-7), one end of the second spring (8-6) abuts against an inner wall of the second bolt bushing (8-2-3-2) and the other end abuts against the second axle bumper (8-7-1) of the second bolt (8-4), and the stop lever (8-1) is arranged on the mounting book (8-3), penetrates through the locking groove (8-2-3-1) and is located at the inner side oldie second bolt (8-7);

when the second bolt (8-7) is pulled downwardly, the main body (1) is capable of rotating around, the second spindle (8-9), and the first bolt (8-5) is inserted into the radial lock hole (8-9-1) of the second spindle (8-9) to enable the main body (1) to be tightly locked after overturning around the second spindle (8-9).

6. The electric outboard motor for the boat according to claim 5, wherein, the mounting book connection plate (8-2-2) of the spindle mounting base (8-2) has a second spindle bushing (8-2-2-2), a top of the second spindle bushing (8-2-2-2) is provided with a first bolt bushing (8-2-2-1), the second spindle (8-9) penetrates through the second spindle bushing (8-2-2-2), the mounting hook (8-3) is fixedly connected with the second spindle (8-9), and two ends of the second spindle (8-9) are equipped with locking nuts.

7. The electric outboard motor for the boat according to claim 5, wherein, the mounting hook (8-3) includes a first hook plate (8-3-1) and a second hook plate (8-3-2), and the first hook plate (8-3-1) and the second hook plate (8-3-2) are fixedly connected by a pin roll (8-3-3).

8. The electric outboard motor for the boat according to claim 7, wherein, the first hook plate (8-3-1) is provided with a plurality of first stop lever holes (8-3-1-1), the second hook plate (8-3-2) is provided with a plurality of second stop lever holes (8-3-2-1), and the first stop lever holes (8-3-1-1) on the first hook plate (8-3-1) are in one-to-one correspondence to the second stop lever holes (8-3-2-1) on the second hook plate (8-3-2), the stop lever (8-1) penetrates through the first stop lever holes (8-3-1-1) on the first hook plate (8-3-1) and the second stop lever holes (8-3-2-1) on the second hook plate (8-3-2).

9. The electric outboard motor for the boat according to claim 5, wherein, the spindle mounting bushing (8-2-1) is provided with a pin hole (8-2-1-1), the first spindle (8-4) is provided with a plurality of locking through holes (8-4-1) separately distributed along an axial direction thereof, the main body (1) has a first support arm (1-1) and a second support arm (1-2), the first spindle (8-4) is mounted on the first support arm (1-1) and the second support arm (1-2), a height of the first spindle (8-4) between the first support arm (1-1) and the second support arm (1-2) is larger than a height of the spindle mounting bushing (8-2-1), and the pin roll penetrates through the pin hole (8-2-1-1) of the spindle mounting bushing (8-2-1) and the locking through holes (8-4-1) of the first spindle (8-4) to fixedly connect the spindle mounting bushing (8-2-1) with the, first spindle (8-4).

10. The electric outboard motor for the boat according to claim 1, wherein, the motor mounting case (4) includes a motor mounting base (4-1) and a housing (4-2), the motor mounting base (4-1) is mounted on an inner wall of the main body (1), a height adjusting bracket (1-3) is arranged at the position of the main body (1) located under the motor mounting base (4-1), the height adjusting bracket (1-3) is provided with a height adjusting screw (1-4), and one end of the height adjusting screw (1-4) abuts against the motor mounting base (4-1); the transmission component (9) is arranged in the main body (1) and the transmission component (9) includes a driving belt wheel (9-1), a driven belt wheel (9-2) and a transmission belt (9-3); the motor shaft of the motor (2) is equipped with the driving belt wheel (9-1), one end of the paddle shaft (6) is equipped with the driven belt wheel (9-2), and the driving belt wheel (9-1) is in transmission connection with the driven belt wheel (9-2) through the transmission belt (9-3); both of the driving belt wheel (9-1) and the driven belt wheel (9-2) are pulleys, and the transmission belt (9-3) is a leather belt, or both of the driving belt wheel (9-1) and the driven belt wheel (9-2) are synchronous pulleys, and the transmission belt (9-3) is a synchronous belt.

* * * * *